US008692479B2

(12) United States Patent
Mercier et al.

(10) Patent No.: US 8,692,479 B2
(45) Date of Patent: Apr. 8, 2014

(54) METHOD OF CONTROLLING A BALLAST, A BALLAST, A LIGHTING CONTROLLER, AND A DIGITAL SIGNAL PROCESSOR

(71) Applicant: NXP B. V., Eindhoven (NL)

(72) Inventors: Frederic Mercier, Saint Manvieu-Norrey (FR); Philippe Maugars, Ranes (FR)

(73) Assignee: NXP B.V., Eindhoven (NL)

( * ) Notice: Subject to any disclaimer, the term of this patent is extended or adjusted under 35 U.S.C. 154(b) by 37 days.

(21) Appl. No.: 13/659,519

(22) Filed: Oct. 24, 2012

(65) Prior Publication Data

US 2013/0113391 A1 May 9, 2013

(30) Foreign Application Priority Data

Nov. 7, 2011 (EP) ..... 11290515

(51) Int. Cl.
*H05B 37/02* (2006.01)

(52) U.S. Cl.
USPC ..... 315/291; 315/185 R; 315/297

(58) Field of Classification Search
USPC ..... 315/185 R, 192, 291, 294, 297
See application file for complete search history.

(56) References Cited

U.S. PATENT DOCUMENTS

2007/0285028 A1* 12/2007 Tsinker et al. ..... 315/224
2008/0258647 A1 10/2008 Scianna
2011/0121744 A1 5/2011 Salvestrini et al.
2011/0121751 A1* 5/2011 Harrison et al. ..... 315/291
2012/0056553 A1* 3/2012 Koolen et al. ..... 315/291
2012/0126714 A1* 5/2012 Deppe et al. ..... 315/192
2012/0146526 A1* 6/2012 Lam et al. ..... 315/200 R

FOREIGN PATENT DOCUMENTS

WO 2011/013060 A2 2/2011
WO 2011/114261 A1 9/2011

OTHER PUBLICATIONS

Rand, D., et al.; "Issues, Models and Solutions for Triac Modulated Phase Dimming of LED Lamps"; Power Electronics Specialists Conf. 2007; IEEE, Piscataway, NJ, US; pp. 1398-1404 (Jun. 17, 2007).
NXP Semiconductors; "AN10754 Application Note: SSL2101 and SSL2102 Dimmable Mains LED Driver"; pp. 1-26; retrieved from the Internet: http://www.nxp.com (Oct. 16, 2009).
NXP Semiconductors; "SSL2101 Product Data Sheet: SMPS IC for Dimmable LED Lighting"; pp. 1-22; (Aug. 28, 2009).
Extended European Search Report for application No. 11290515.3 (Apr. 27, 2012).

* cited by examiner

*Primary Examiner* — Jason M Crawford

(57) ABSTRACT

A method of controlling a ballast in a circuit for a lighting application and connected to a mains power supply is disclosed. The method comprises determining whether a dimmer is present in the circuit; in response to detecting that a dimmer is present, determining a zero-crossing of the power supply and setting a bleeder current through the ballast in dependence on the phase of the power supply within a mains half-cycle; and in response to determining that a dimmer is not present, disabling the bleeder current. A ballast which is controlled by such a method is also disclosed. Additionally, a controller, which may include a digital signal processor, for a ballast and operable according to the above method is disclosed.

13 Claims, 4 Drawing Sheets

METHOD OF CONTROLLING A BALLAST, A BALLAST, A LIGHTING CONTROLLER, AND A DIGITAL SIGNAL PROCESSOR

CROSS-REFERENCE TO RELATED APPLICATIONS

This application claims the priority under 35 U.S.C. §119 of European patent application no. 11290515.3, filed on Nov. 7, 2011, the contents of which are incorporated by reference herein.

FIELD OF THE INVENTION

This invention relates to method of controlling ballasts for lighting circuits, to ballasts for lighting circuits, to lighting controllers, and to digital signal processors.

BACKGROUND OF THE INVENTION

There is an increasing interest in energy efficient lighting to replace conventional incandescent bulbs, not least because of environmental concerns. Whereas compact fluorescent lamps (CFL) presently dominate energy efficient lighting, there is an increasing move towards light emitting diode (LED) lighting. Not only does this offer the prospect of a significant reduction in energy consumption, with respect even to CFL, but use of environmentally damaging materials such as mercury can be reduced.

However, in common with CFL, LED lighting typically takes the form of a high ohmic load. This presents challenges for existing lighting circuits incorporating a dimmer circuit: the most common types of dimmer circuits are phase-cut dimmers, in which the mains supply is cut off for part of the mains cycle—either the leading edge of the cycle or half-cycle, or its trailing edge. Most trailing edge dimmers are based on a transistor circuit, whereas most leading edge dimmers are based on a triac circuit. Both transistor and triac dimmers require to see a low ohmic load.

To satisfy this requirement, it is known to provide LED driver circuits (also known as electronic ballasts), with a "bleeder", which presents a relatively low ohmic load to the dimmer circuit in order to ensure that it operates correctly. However, if the circuit including bleeder is connected to a non-dimmable mains connection, the bleeder operates unnecessarily, resulting in an efficiency drop, which typically can be up to 10%, and potentially increased electromagnetic interference (EMI) problems if the bleeder is dynamically controlled.

An LED driver circuit is known in which the bleeder may be disconnected in the absence of a dimmer circuit. Such a circuit is disclosed for instance in United Kingdom Patent Application publication GB-A-2535726.

There is thus an ongoing need to better control or to limit the losses associated with bleeder functionality.

SUMMARY OF THE INVENTION

According to an aspect of the present invention, there is provided a method of controlling a ballast in a circuit for a lighting application and connected to a mains power supply, the method comprising determining whether a dimmer is present in the circuit; in response to detecting that a dimmer is present, determining a moment indicative of a zero-crossing of the power supply and setting a bleeder current through the ballast in dependence on the phase of the power supply within a mains half-cycle; and in response to determining that a dimmer is not present, disabling the bleeder current.

Thereby, the bleeder strategy for the ballast and may be determined "in situ" and may be different for different types of dimmers. Moreover, by setting a bleeder current through the ballast within a mains half-cycle, the bleeder current may be different at different parts of the mains half-cycle, which may provide for enhanced efficiency or lower losses, since the current may be supplied only when required, or the current may be disabled when not required.

In embodiments, determining the presence of a dimmer comprises determining whether a trailing edge dimmer is present and determining whether a leading edge dimmer is present. In embodiments, setting a bleeder current through the ballast in dependence on the phase of the power supply comprises, in the case that a trailing edge dimmer is present: determining a phase of the trailing edge; setting a first dimmer current during a part of the mains half-cycle including the trailing edge; and at least one of setting a second dimmer current, lower than the first dimmer current, during a later part of the mains half-cycle, and disabling the dimmer current during an earlier part of the mains half-cycle. In comparison with bleeder controls circuits which are fixed or hardwired into the apparatus, such control of the bleeder current within a mains half cycle may provide a significant improvement in efficiency of the overall system.

In embodiments setting a bleeder current through the ballast in dependence on the phase of the power supply comprises, in the case that a leading edge dimmer is present, determining the phase of the leading edge; setting a latching dimmer current during a part of the mains half-cycle including the leading edge, and setting a synchronisation dimmer current, lower than the latching dimmer current, during a further, earlier, part of the mains half-cycle. The further part of the mains half-cycle is thus earlier than the part during which the latching dimmer current is set.

In embodiments setting a bleeder current through the ballast in dependence on the phase of the power supply further comprises setting a holding dimmer current, lower than the latching dimmer current, during a yet further, later, part of the mains half-cycle. The yet further part of the mains half-cycle is thus later than the part during which the latching dimmer current is set. The part during which the latching dimmer current is set and the yet further part may be contiguous, or there may be a gap between the part and the yet further part during which there is no holding current. The holding current may be applied until the end of the mains half cycle, or there may be a gap after the yet further part.

In embodiments setting a bleeder current through the ballast in dependence on the phase of the power supply further comprises setting a non-zero holding dimmer current, lower than the latching dimmer current, during the yet further, or later, part of the mains half-cycle for some of a group of mains half-cycles, and setting the bleeder current to zero during the respective later part of the mains half-cycle for the remainder of the group of mains half-cycles. Since it may not be necessary to measure the phase angle during every mains half cycle, thus when no current is sunk by the converter, setting the holding dimmer current to zero for at least some half-cycles may provide for an improved efficiency of the apparatus.

In embodiments the synchronisation dimmer current has a different value to the holding dimmer current. In particular, the synchronisation current may be higher or lower than the holding current; in general, though, since the voltage across the switch is very low, the power dissipated by a higher synchronisation current is not significant.

In embodiments determining a moment indicative of a zero-crossing of the power supply comprises determining a moment at which a rectified voltage of the power supply with a reference voltage is less than a reference voltage, In embodiments a digital circuit is used to effect at least one of determining whether a dimmer is present in the circuit, determining a zero-crossing of the power supply, setting a bleeder current through the ballast in dependence on the phase of the power supply within a mains half-cycle, and disabling the bleeder current. Digital signal processing is particularly convenient in that a complex circuit need not be required to carry out even a relatively complex control scheme such as those described above. The cost of the apparatus overall may thus be lower than an equivalent analogue circuit. Furthermore, adaptation of control strategy may be simpler to implement using such a digital circuit.

According to another aspect, there is provided a ballast circuit for a lighting application and for being supplied by a mains power supply, the ballast circuit comprising means for determining whether a dimmer is present in the circuit; means for determining a zero-crossing of the power supply; and means for setting a bleeder current through the ballast; the ballast circuit being configured to operate a method as described above in this section.

In embodiments, at least one of: the means for determining whether a dimmer is present in the circuit comprises a dimmer detection circuit; the means for determining a zero-crossing of the power supply comprises a zero-crossing detection circuit; and the means for setting a bleeder current through the ballast comprises a controllable current source or a variable resistor. In embodiments at least one of the means for determining whether a dimmer is present in the circuit and the means for determining a zero-crossing of the power supply comprises a digital signal processing circuit.

According to yet another aspect there is provided a lighting control comprising a ballast circuit has just described. According to yet another aspect there is provided a digital signal processor configured to operate a method as described above in this section.

These and other aspects of the invention will be apparent from, and elucidated with reference to, the embodiments described hereinafter.

BRIEF DESCRIPTION OF DRAWINGS

Embodiments of the invention will be described, by way of example only, with reference to the drawings, in which.

DETAILED DESCRIPTION OF EMBODIMENTS

Figure 1:
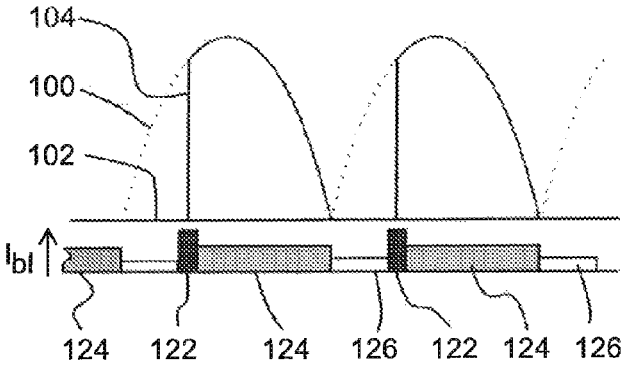
FIG. 1 illustrates the current supplied by a leading-edge phase-cut dimmer, together with bleeder currents according to embodiments of the invention.

FIG. 1 illustrates the current supplied by a leading-edge phase-cut dimmer, together with bleeder currents according to embodiments of the invention. The figure shows a generally sinusoidal mains voltage 100. Although in the figure of the voltage is shown as half-rectified, the skilled person would appreciate that the voltage need not be half-rectified. Further, the minimum of the half-rectified mains voltage is shown at zero, which corresponds to a zero-crossing of the unrectified mains voltage. The figure shows that whilst the input voltage is sinusoidal, the output voltage remains 0 (shown at 102) until the input reaches a predetermined voltage set by the dimmer (typically a triac), at which moment the triac triggers and the dimmer output voltage rapidly increases (as shown at 104) to the input voltage. It will be appreciated that although the voltage is shown increasing instantaneously to correspond to the input voltage by vertical line 104, in practice the increase will not be instantaneous, but rather will take a finite period of time; the speed of the increase (which is also known as the slew rate) will be determined by the inductance of the circuit.

As is generally known, the dimmer switch—in this case a triac—requires that a certain level of current ($I_{bt}$) be available to it, in order to properly trigger. This current is termed the "latch" current. Further, once triggered the dimmer continues to require a level of current through it in order to ensure that the triac continues to operate. This current is termed the "hold" current. The inventors have appreciated that the current required to ensure the triac stays on is generally less than that required to ensure it triggers. Since the higher bleeder current is only required around the time of triggering, the current can be reduced for the remainder of the phase, thereby reducing the energy wasted by the bleeder. Thus, as shown in FIG. 1, the current $I_{bl}$ (at 122) around the time of triggering is higher than that (shown at 124) during the remainder of the main half-cycle.

As also shown in FIG. 1, during the first part of the main half cycle, a further current, 126, may be supplied by the bleeder. This current, the "synchronisation current" may be required, particularly in the case of a triac switch, to ensure that it will be able to fire when it is triggered. That is to say; the phase at which the triac is triggered is determined from the time constant of an RC circuit. In order for the RC circuit to properly act as a timing circuit, a certain level of current is required to charge the capacitor. Absent this current, the timing circuit would not operate, and so the triac would not be ready to fire at the correct time.

In summary, in embodiments comprising a conventional triac dimmer in which the phase-cut timing is determined by an RC circuit, a non-zero value for the synchronisation current will generally be required; however, there may be other means of establishing this timing.

As already mentioned, once the triac has been triggered, current is generally required to ensure that it continues to operate. In the embodiment shown in FIG. 1, a fixed, non-zero holding current 124 is provided by the bleeder. However, some of the required current may be supplied by the converter current. That is to say, since the convertor is operating, it will draw current from the mains. This drawn, or converter, current may be sufficient to ensure the triac remains on, in which case, no further current is actually required from the bleeder. This is particularly the case towards the end of the mains half-cycle, when the mains voltage is relatively low, and thus a relatively high converter current is required to be drawn to provide constant power to the LEDs. However, during the part of the mains half-cycle when the voltage is relatively high, the drawn current is relatively low, and additional current (holding current), will be required to ensure the triac remains on. Thus in embodiments, it may be possible to vary the holding current (or even set it to zero during some part of the half-cycle). In the case that the dimmer is operated to heavily cut the phase (for instance so the LEDs are on for less than one third of the mains half cycle), the mains voltage may already be sufficiently low, at the moment that the triac is triggered, so that the converter current is sufficient to ensure the triac stays on, and no holding current is required from the bleeder at all.

Further, in embodiments in which the voltage on the internal capacitor of the converter is higher than the mains voltage making diode between 430 and 440 non conductive, (i.e. the converter will not sink current any more on the mains), it may not be necessary to provide a "holding" current for every cycle. In an example embodiment, holding current is supplied by the bleeder only for one in every four cycles (sufficient to ensure that mains phase has not drifted appreciably, and to allow for any user-supplied changes to the phase-cut edge).

Figure 2:
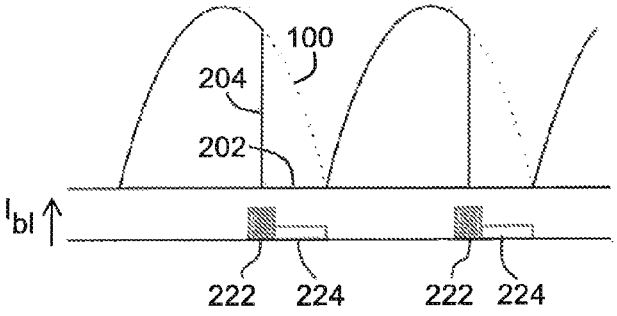
FIG. 2 illustrates the current supplied by a trailing-edge phase-cut dimmer together with bleeder currents according to embodiments of the invention.

Turning now to FIG. 2, this figure illustrates the power supplied by a trailing edge phase-cut dimmer together with bleeder currents according to embodiments of the invention. This figure is generally similar to that of FIG. 1, but this time the generally sinusoidal mains power supply 100 has its trailing edge cut, at 204, such that the voltage supplied by the dimmer is zero, at 202, for the final part of the half cycle. The skilled person will appreciate that such trailing-edge dimmers usually employ a transistor as the active device, rather than the triac typically employed in a leading-edge phase-cut dimmer.

The transistor generally requires a certain bleed current, the "discharge" current, in order to correctly operate to cut the phase. Specifically, the discharge current 222 is required to discharge the internal capacitor of the dimmer sufficiently quickly that the dimmer has a proper falling edge 204. Absent this discharge current, the dimmer will operate correctly, but the external circuit will not see a falling edge. The inventors have appreciated that, again similarly to the operation of a triac-based dimmer, this relatively high discharge current is only required around the moment of cutting the phase. Thus, rather than supply a continuous high current by means of a fixed bleeder, according to embodiments of the invention the discharge current is only supplied for a brief period or momentarily, shown at 222. After the supply has been cut, it is generally necessary for the ballast to supply a further current, shown at 224, to provide sufficient power supply for the dimmer to operate. Since it does not have to ensure the correct operation of the phase-cutting of the active device, this second current, which may be described as a "supply" current, may be significantly lower than that required for the discharge. Although the supply current is shown as contiguous with the discharge current, provided there is sufficient time to provide sufficient energy to enable the transistor to switch on at the start of the next mains half-cycle, in embodiments it may be necessary to provide current 224 only during part of the remainder of the half-cycle.

Once the zero-crossing has been established, or a moment indicative of the zero-crossing has been determined, as described above, and the phase of the phase-cut is known, it is possible to ensure that the discharge current is supplied through the bleeder just in time for the phase-cut. Thus during the first part of the phase, whilst the dimmer is supplying voltage, there is no requirement for a bleed current at all, and thus the bleeder may be completely disabled during this part of the phase, thereby providing a significant saving in energy.

Figure 3:
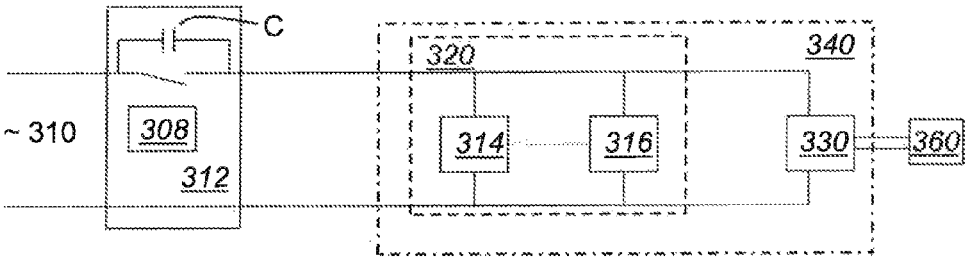
FIG. 3 shows a schematic diagram of a lighting system with a phase-cut dimmer and a ballast circuit including a bleeder.

FIG. 3 shows a schematic diagram of a lighting system with a phase-cut dimmer and a ballast circuit including a bleeder. The figure shows a mains power supply 310, which is connected to a dimmer 312. The dimmer 312 comprises an active switching device 308, which is opened for a part of the mains half-cycle. The dimmer device may also include a filter comprising a capacitor C. Alternatively or in addition, the filter may comprise an inductive coil. The output from the phase-cut dimmer 312 is connected to a ballast circuit 320. The ballast circuit 320 comprises a bleeder 314 and a controller 316. The output from the dimmer 312 is also connected to a driver circuit 330, which drives a lighting application 350, such as a string of LEDs. Ballast circuit 320 and a driver 330 may comprise parts of a power converter 340.

In operation, the controller 316 determines the phase of the mains power supply, for example by detecting a zero crossing, and controls the bleeder 314 in response to the phase. The function of the bleeder is to ensure that the dimmer has sufficient current through it to ensure correct triggering of the active device, and thus, apart from when it is completely disabled, the bleeder will appear to the dimmer 312 to be an impedance, having an impedance which is determined by the controller. As the skilled person will appreciate, there are many different ways of implementing such a variable bleeder, including a voltage controlled resistor.

Figure 4:
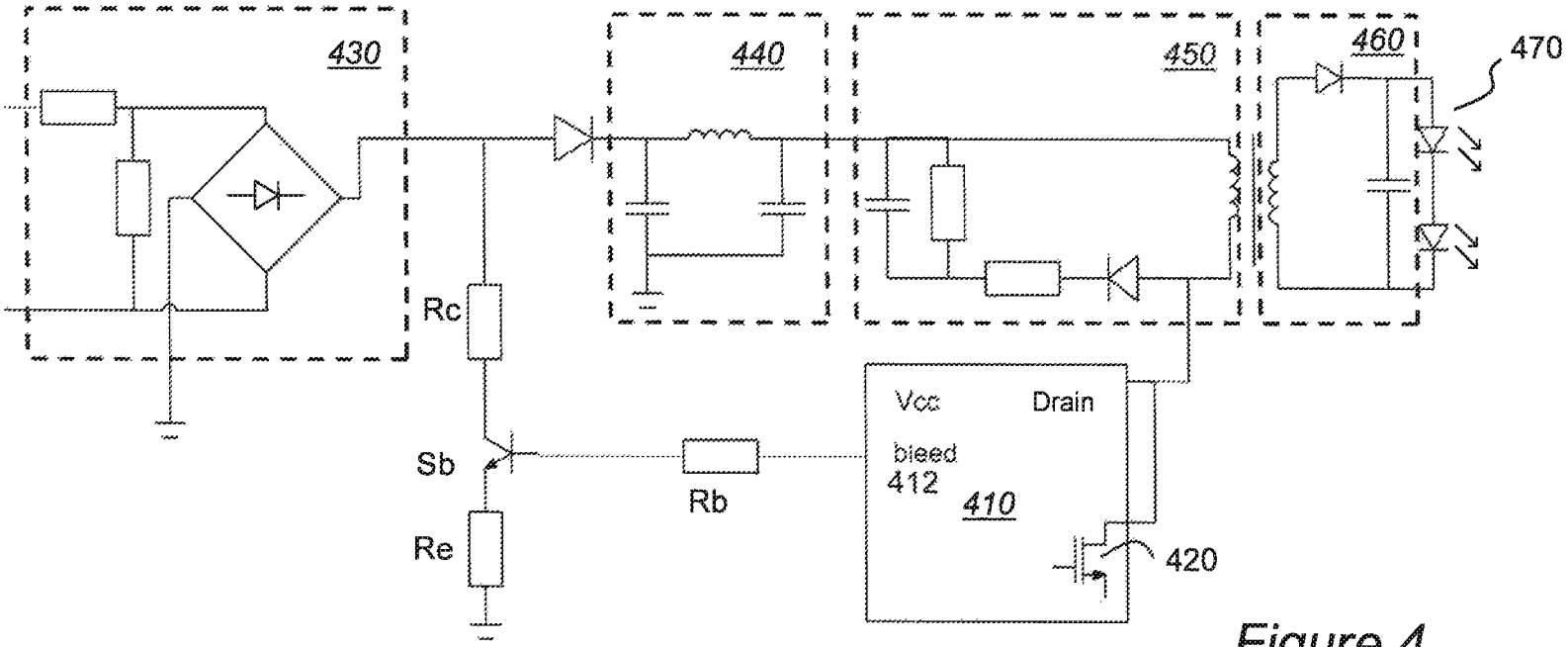
FIG. 4 shows a lighting control arrangement in which the controller enables a variable bleeder current.

An example of a variable bleeder is shown in FIG. 4. This figure shows a controller 410 for controlling a switch 420 of a converter and having a bleed pin 412 for controlling a bleeder (Rc, Re, Rb, Sb). The converter includes a rectifier 430, a filter 440, input stage 450 and output stage 460. The switch may be integral with the driver, as shown, or may be a separate component. As shown, the converter may be used for an LED application, to provide power to a string of LEDs 470. The bleed pin 412 of controller 410 is coupled to the gate (or base) of a transistor which forms switch Sb. The transistor may be controlled in its linear region, by suitable choice of emitter and collector resistors Re and Rc respectively, so that the bleeder can draw a variable current from the circuit, in dependence on the output of the bleed pin 412.

Figure 5:
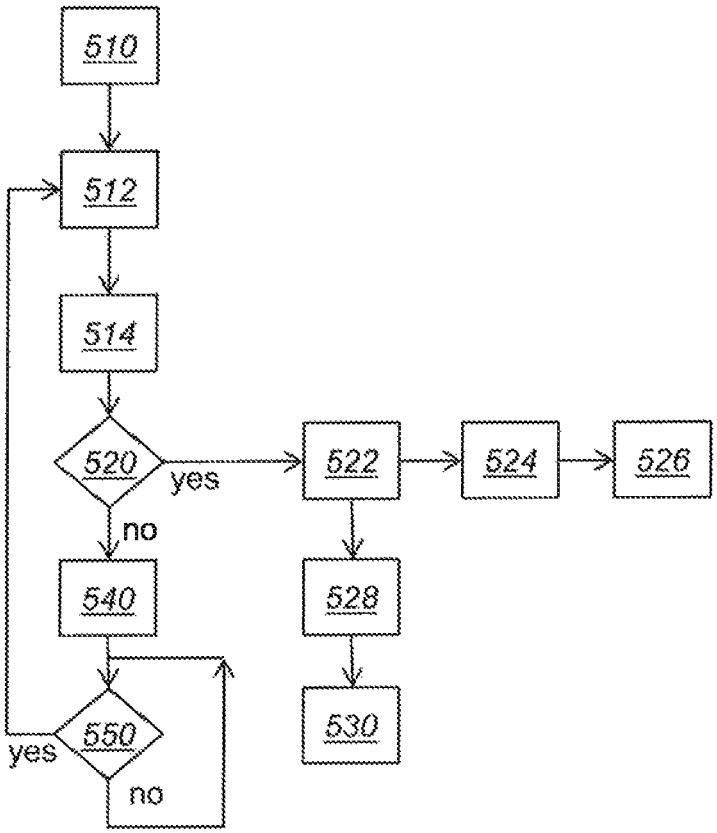
FIG. 5 is a flow diagram of an initial phase of a method of controlling a ballast according to embodiments of the invention.

FIG. 5 is a flow diagram of an initial phase of a method of controlling a ballast according to embodiments of the invention. The various stages of the flow diagram are as follows:

510 power on;
512 bleeder on Max current;
514 wait (prevent for intelligent dimmer);
520 dimmer detected ?;
If yes to 520, then
  522 dimmer type recognition; and either
  524 save edge position and
  526 go to trailing strategy, or
  528 save edge position and
  530 go to leading-edge strategy;
if no to 520 then
  540 bleeder off
  550 check dimmer error?
    if no to 550 then return to 550;
    if yes to 550 then goto bleeder on max current (512).

In other words, according to the flow diagram shown in FIG. 4, when the system is started (at 510), the power is switched on and the bleeder is initially set at 512 to a maximum current level (corresponding to a lowest impedance value). After waiting (514) for a suitable time in case the dimmer is an intelligent dimmer and requires a finite time to warm up, a detection event is carried out (520) in order to determine whether a dimmer is present. Such detection has been described elsewhere, and will be well known to the skilled person. For instance, the actual RMS (root mean square) voltage on the mains may be estimated—and if it is lower than that expected for a complete mains half-cycle, it may be inferred that a dimmer is present. For example, the rms voltage for a mains with 230V peak is approximately 160V. Alternatively, dimmer detection may be carried out by slope detection: if a dimmer is present, there will be a significantly higher slope of the voltage—at the phase-cut edge—than would be the case were no dimmer present. If a dimmer is detected, the type of dimmer is then detected (at 522), and irrespective of the type of dimmer, the edge position is determined at 524, 528 and control moves to the respective trailing edge strategy (526) or leading-edge strategy (530) according to the type of dimmer which was detected. In case that no dimmer is detected at 520, the bleeder is switched off at 540. A check is then periodically carried out at 550 that there has been no dimmer error—in particular that it is really correct that no dimmer is present. This is desirable, since if a dimmer is present but is set not to cut the phase at all, it may appear to the controller that a dimmer is not present. If a dimmer error is determined, then control returned to 512 at which the bleeder current is reset to the maximum, and control proceeds from there.

Figure 6:
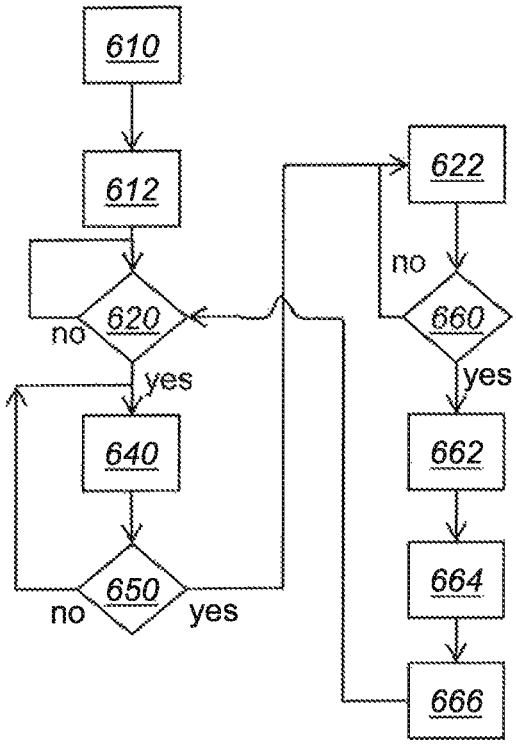
FIG. 6 shows a flow diagram of a strategy of controlling a ballast with a leading edge phase-cut dimmer connected, according to embodiments of the invention.

FIG. 6 shows a flow diagram of a strategy of controlling a ballast with a leading edge phase-cut dimmer connected, after conclusion of the initial phase just described with respect to FIG. 5, according to embodiments of the invention. The various stages of this flow diagram are as follows:

610 start;
612 load edge position T_edge;
620 detect zero crossing?;
If no [to 620] go to 620;
If yes [to 620]:
  640 set bleeder current to synchronisation current;
  650 check for (T−T_edge<x μs);
  if no [to 650] go to 640;
  if yes [to 650]:
    622 set bleeder current to latch current value;
    660 detect rising edge?
    if no [to 660] go to 622;
    if yes [to 660]:
      662 save edge position;
      664 wait 500 μs: switch bleeder off;
      666 I_sense measurement and bleeder holding current optimisation;
      go to 620.

In other words, according to this part of a control method, once the initial phase has completed and the control moves to this part of the method at 610, the phase-cut edge position (T_edge) is identified at 612. The phase-cut edge position may be identified as part of the initial phase.

The controller checks for zero crossing detection at 620, and repeats until a zero crossing is detected at which point the bleeder current is set to the synchronisation current (at 640). In practical embodiments, the zero crossing detection (at 620) is effected by means of a comparator. The mains voltage is compared to a predetermined reference level, The comparator may go low, when the mains voltage falls below the reference voltage; this is indicative of the zero crossing. It will be appreciated that this results in an offset from the "true" zero crossing. For instance, in the case of a 230V mains supply the reference voltage may be 20V (which corresponds to a phase offset of approximately 5°, or 10V corresponding to a phase offset of 2½°). The mains half-cycle may be treated as starting when the comparator goes low (i.e. the offset is ignored), or a delay built-in to adjust for the off-set.

The bleeder current is kept at the synchronisation current, until the phase-cut edge is approached. When the anticipated phase-cut edge is sufficiently closely approached, within, say, x μs, the bleeder current is set to a latch level, which may be its maximum value, at 622, after which it is waited until the rising edge is detected at 660.

The value x may be set to a suitable value, for instance, to 500 μs (corresponding to a 4.5° phase angle for a typical 50 Hz mains supply). It will be appreciated that a different value of x may be used, for instance, for a controller which is intended for a 60 Hz mains supply environment, a correspondingly smaller value may be used. Alternatively a value corresponding to a phase angle of, as non-limiting examples, 2.5° up to 7.5° may be used. The value x should ensure that the bleeder current is high (at the latch current level) when the phase-cut edge is reached. A non-zero value for x is generally required both to provide for drift in the phase (either measured or real), and to allow for any user-supplied changes to the position of the phase-cut edge.

Once the rising edge has been detected, the actual edge position is saved at 662, and after a further delay which as shown may be 500 μs μs, the bleeder may be switched off completely at 664. Thereafter there is an I_sense measurement and bleeder current optimisation which takes place at step 666: in this step the holding current is established, such that the bleeder provides only the additional current which is required to maintain the operation of the triac (to ensure the triac does not switch off prematurely). As already discussed, this may be required to ensure the triac operation is maintained.

Figure 7:
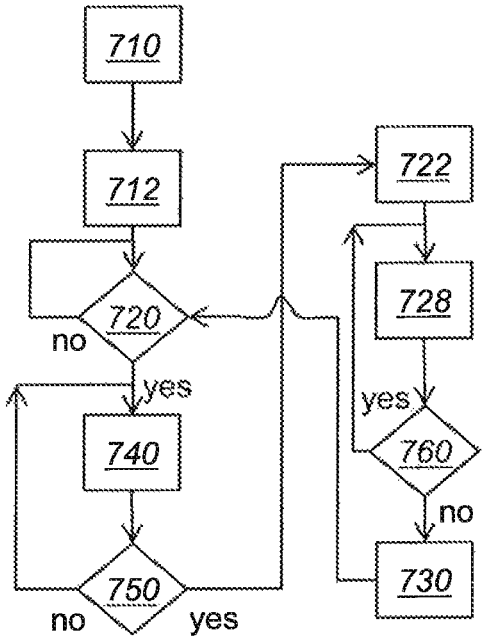
FIG. 7 shows a flow diagram of a strategy for controlling a ballast with a trailing edge phase-cut dimmer connected, according to embodiments of the invention, It should be noted that the figures are diagrammatic and not drawn to scale. Relative dimensions and proportions of parts of the figures have been shown exaggerated or reduced in size, for the sake of clarity and convenience in the drawings. The same reference signs are generally used to refer to corresponding or similar feature in modified and different embodiments

FIG. 7 shows a flow diagram of a strategy for controlling a ballast with a trailing edge phase-cut dimmer connected after conclusion of the initial phase described above with respect to FIG. 4, according to embodiment of the invention. The various stages of this flow diagram are as follows:

710 start;
712 load edge position T_edge;
720 check for T−T_edge<y μs?
if no [to 720] then go to 720;
if yes [to 720]:
  740 set bleeder current to discharge level;
  750 detect falling edge ?
  if no [to 750] go to 740;
  if yes [to 750]:
    722 save edge position;
    728 set bleeder current to supply level;
    760 zero voltage detection?
    if yes [to 760] go to 728;
    if no [to 760]:
      730 bleeder off;
      go to 720.

In other words, according to this part of a control method, once the initial phase has completed and the control moves to this part of the method at 710, the phase-cut edge position (T_edge) is identified at 712. Similarly to the leading edge case, the phase-cut edge position may be identified as part of the initial phase.

As discussed above, a value indicative of zero crossing may be identified, for example by means of a comparator and a reference voltage. An adjustment may be made for the resulting offset, or it may simply be ignored (and the start of the mains half-cycle be treated as the moment when the comparator between the mains voltage and the reference voltage goes low.

The bleeder current may be set to zero once the zero crossing is detected. The bleeder current then remains at zero until the anticipated phase-cut edge is approached sufficiently closely. Once the phase-cut edge is approached sufficiently closely, say within an interval "y", where for instance y may be set to 300 μs, the bleeder current is set to a discharge level 222, which may be its maximum value, at 740. Falling edge detection is then awaited (at 750); once the falling edge has been detected, the edge position is saved at 722, and the bleeder current is set to a supply level 224, which may be its minimum value, at 728. The circuit is then periodically or continuously polled to check that there is no voltage at 750, that is to say, the mains zero crossing has not been reached, since once the zero crossing is reached, the voltage will start to rise according to the generally sinusoidal mains. In practice the polling may be effected by using the low voltage comparator described above. All the while there is no voltage—or a voltage which is lower than the comparator reference voltage—it may be inferred that the zero crossing of the mains has not been reached. Of course, it will be appreciated that the discharge of the voltage will not, in practice, normally be instantaneous and complete, as schematically shown in FIG. 2 at falling edge 204, but may include a tail, such that the voltage need not fall entirely to zero, but may approach it exponentially. Once the mains zero crossing is identified, that is to say, in cases in which the a comparator is used, once a voltage is detected which is higher than the low voltage reference voltage, the bleeder is switched off at 730 and control moves back to 720 to await the moment which precedes the expected phase-cut position 750, by interval y.

As a further aspect, a pin may be added to the controller in order to sense the current which is sunk by the converter itself. If the converter current is sufficiently large to power the dimmer, then a separate bleeder current is not required, and the bleeder circuit may be disabled.

It will be appreciated that the control strategies described above, which would be complex to implement by analogue circuitry, are particularly suited to implementation by means of digital signal processing. By use of digital signal processing, the control strategy may be adapted; for instance, the controller may determine that the mains frequency is either more stable or less stable than expected, and in consequence may increase (or decrease) the number of mains half cycles for which the sink current (in the control of a leading-edge dimmer) or supply current 224 (in the case of a trailing edge dimmer) is disabled, before the mains zero crossing should be rechecked.

From reading the present disclosure, other variations and modifications will be apparent to the skilled person. Such variations and modifications may involve equivalent and other features which are already known in the art of lighting circuits compatible with the mains dimmers, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination.

The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

The invention claimed is:

1. A method of controlling a ballast in a circuit for a lighting application and connected to a mains power supply, the method comprising determining whether a dimmer is present in the circuit, comprising determining whether a trailing edge dimmer is present and determining whether a leading edge dimmer is present;

in response to detecting that a dimmer is present, determining a moment indicative of a zero-crossing of the power supply and setting a bleeder current through the ballast in dependence on the phase of the power supply within a mains half-cycle; and in response to determining that a dimmer is not present, disabling the bleeder current:

wherein setting bleeder current through the ballast in dependence on the phase of the power supply comprises, in the case that a trailing edge dimmer is present:

determining a phase of the trailing edge;

setting a first bleeder current during a part of the mains half-cycle including the trailing edge;

and at least one of setting a second bleeder current, lower than the first bleeder current, during a later part of the mains half-cycle, and disabling the bleeder current during an earlier part of the mains half-cycle.

2. The method of claim 1, wherein there is a gap between the part of the mains half-cycle including the trailing edge and the later part of the mains half-cycle, during which gap the dimmer current is disabled.

3. The method of claim 2, wherein setting a bleeder current through the ballast in dependence on the phase of the power supply comprises, in the case that a leading edge bleeder is present, determining the phase of the leading edge;

setting a latching bleeder current during a part of the mains half-cycle including the leading edge and setting a synchronisation bleeder current, lower than the latching bleeder current, during an earlier part of the mains half-cycle.

4. The method of claim 3, wherein setting a bleeder current through the ballast in dependence on the phase of the power supply further comprises setting a holding bleeder current, lower than the latching bleeder current, during a later part of the mains half-cycle.

5. The method of claim 3 wherein setting a bleeder current through the ballast in dependence on the phase of the power supply further comprises setting a non-zero holding bleeder current, lower than the latching bleeder current, during a later part of the mains half-cycle for some of a group of mains half-cycles, and setting the bleeder current to zero during the respective later part of the mains half-cycle for the remainder of the group of mains half-cycles.

6. The method of claim 3, wherein the synchronisation bleeder current is lower than the holding bleeder current.

7. The method of claim 1, wherein determining a moment indicative of a zero-crossing of the power supply comprises determining a moment at which a rectified voltage of the power supply with a reference voltage is less than a reference voltage.

8. The method of claim 1, wherein a digital circuit is used to effect at least one of determining whether a dimmer is present in the circuit, determining a zero-crossing of the power supply, setting a bleeder current through the ballast in dependence on the phase of the power supply within a mains half-cycle, and disabling the bleeder current.

9. A ballast circuit for a lighting application and for being supplied by a mains power supply, the ballast circuit comprising means for determining whether a dimmer is present in the circuit;

means for determining a zero-crossing of the power supply;

and means for setting a bleeder current through the ballast;

the ballast circuit being configured to operate the method of claim 1.

10. A ballast circuit according to claim 8, wherein at least one of:

the means for determining whether a dimmer is present in the circuit comprises a dimmer detection circuit;

the means for determining a zero-crossing of the power supply comprises a zero-crossing detection circuit; and the means for setting a bleeder current through the ballast comprises a controllable current source or a variable resistor.

11. A ballast circuit according to claim 8, wherein at least one of the means for determining whether a dimmer is present in the circuit and the means for determining a zero-crossing of the power supply comprises a digital signal processing circuit.

12. A lighting controller comprising a ballast circuit as claimed in claim 8.

13. A digital signal processor configured to operate the method of claim 1.

* * * * *